US009278042B2

(12) United States Patent
Osterhaus

(10) Patent No.: US 9,278,042 B2
(45) Date of Patent: Mar. 8, 2016

(54) WALKING REHABILITATION ASSISTANCE DEVICES

(71) Applicant: Arnie Osterhaus, Portland, OR (US)

(72) Inventor: Arnie Osterhaus, Portland, OR (US)

( * ) Notice: Subject to any disclaimer, the term of this patent is extended or adjusted under 35 U.S.C. 154(b) by 0 days.

(21) Appl. No.: 14/730,145

(22) Filed: Jun. 3, 2015

(65) Prior Publication Data

US 2015/0342822 A1 Dec. 3, 2015

Related U.S. Application Data

(60) Provisional application No. 62/007,356, filed on Jun. 3, 2014.

(51) Int. Cl.
*A61H 3/04* (2006.01)
*A61H 3/00* (2006.01)

(52) U.S. Cl.
CPC . *A61H 3/04* (2013.01); *A61H 3/008* (2013.01)

(58) Field of Classification Search
CPC ..... A61H 2003/007; A61H 2003/046; A61H 3/04; A61H 3/008
See application file for complete search history.

(56) References Cited

U.S. PATENT DOCUMENTS 2,556,121 A * 6/1951 Thomas ..... A61G 5/10 280/304.1
4,345,790 A * 8/1982 Coe ..... A61H 3/00 297/276
4,621,804 A * 11/1986 Mueller ..... A47D 13/043 135/67
5,058,912 A * 10/1991 Harroun ..... A61H 3/04 135/67
5,133,377 A * 7/1992 Truxillo ..... A61H 3/04 135/67
6,003,532 A * 12/1999 Pi ..... A61H 3/04 135/67
7,703,465 B2 * 4/2010 Diamond ..... A45B 7/00 135/67
8,720,914 B1 * 5/2014 Heath ..... A61H 3/04 135/67
2002/0140196 A1 * 10/2002 Crouch ..... A61H 3/04 280/87.051
2003/0070702 A1 * 4/2003 Ownes ..... A61H 3/00 135/74
2008/0182728 A1 * 7/2008 Glasscock ..... A61H 3/04 482/68
2010/0163087 A1 * 7/2010 Catton ..... A61H 3/04 135/67
2011/0272913 A1 * 11/2011 Diamond ..... A61H 3/04 280/288.2
2012/0048318 A1 * 3/2012 Zendzian ..... A61H 3/04 135/66
2013/0178767 A1 * 7/2013 Dreske ..... A61H 3/008 601/23
2014/0261591 A1 * 9/2014 Velarde ..... A61H 3/00 135/67
2015/0115556 A1 * 4/2015 Ledea ..... A61H 3/008 280/79.11

* cited by examiner

*Primary Examiner* — Jeffrey J Restifo
*Assistant Examiner* — Erez Gurari
(74) *Attorney, Agent, or Firm* — Mohr Intellectual Property Law Solutions, PC

(57) ABSTRACT

Walking rehabilitation assistance devices that facilitate mobility in users that are rehabilitating for walking. The walking rehabilitation assistance device is essentially a support frame with wheels and a seat for the user that is attached to a flexible strap. The user straddles the seat, which in turn is attached to a tensioning device, allowing the seat to be raised so as to transfer some or all of the user's weight from the user's legs to the walking rehabilitation assistance device. In some examples, the walking rehabilitation assistance device includes a rigid seat receiver that is connected to the flexible strap, to enable the use of different styles of seats such as bicycle seats, and may provide enhanced stability in certain circumstances.

20 Claims, 6 Drawing Sheets

100

WALKING REHABILITATION ASSISTANCE DEVICES

CROSS REFERENCE TO RELATED APPLICATIONS

This application claims priority to copending U.S. Application Ser. No. 62/007,356, filed on Jun. 3, 2014, which is hereby incorporated by reference for all purposes.

BACKGROUND

The present disclosure relates generally to physical therapy assistive devices. In particular, devices for assisting with rehabilitation of walking are described.

People routinely require rehabilitation for walking as a result of aging, stroke, or other injuries. Such rehabilitation is typically performed under the supervision of a medical professional, and frequently in the context of a medical facility, such as an outpatient clinic or other specialized rehabilitation clinic. Ways this rehabilitation is conducted include the use of support apparatuses that help ease the load off a patient's feet, helping the patient to correct an uneven gait or limp, while the patient simultaneously relearns muscle coordination and builds muscle strength. Such support apparatuses are typically used in conjunction with a frame that is fixed over a treadmill, to allow the patient to rehabilitate through use of the treadmill. In addition to specialized support apparatuses, conventional walkers and wheelchairs may also be used to allow the patient mobility beyond a medical facility or rehabilitation clinic.

These known apparatuses, including conventional walkers and wheelchairs, are not entirely satisfactory for the range of applications in which they are employed. For example, support apparatuses used in conjunction with treadmill are fixed in the single location of the treadmill, and are therefore limited in use to only those times that the patient is in a rehabilitation clinic, or has spent the money to equip a home treadmill with a support apparatus. Likewise, because usage is only possible in connection with the treadmill, such apparatuses are unsuitable for continuous rehabilitation during life's day to day activities. Conventional walkers and wheelchairs, while useable continuously on a daily basis, are not well-suited to good rehabilitation, as they can lead to the development of bad habits that are contrary to the goals of an effective rehabilitation. For example, because conventional walkers do not support the patient user, instead allowing the patient's full weight onto the patient's legs and feet, the patient will have a tendency to prefer the stronger leg, resulting in the potential development of a limp or abnormal gait. The development of a limp or gait works against the goals of rehabilitation. An example of such an abnormal gait is called "step-gather," where the patient consistently leads off with either the left or the right leg for the initial walker movement, then follows by "gathering" the other leg back to the lead-off leg to return to a standing position prior to again moving the walker. This has a tendency to reinforce a single leg being stronger and dominant.

Thus, there exists a need for walling rehabilitation assistance devices that improve upon and advance the design of known walking rehabilitation equipment. Examples of new and useful walking rehabilitation assistance devices relevant to the needs existing in the field are discussed below.

Disclosure addressing one or more of the identified existing needs is provided in the detailed description below. Examples of references relevant to walking rehabilitation assistance devices include commercial devices such as the AlterG, viewable at www.alterg.com, and the Boomer Ez-Walk, viewable at www.facebook.com/boomermobility. The complete disclosures of the above patents and patent applications are herein incorporated by reference for all purposes.

SUMMARY

The present disclosure is directed to a walking rehabilitation assistance device that facilitates mobility in users that are rehabilitating for walking. The walking rehabilitation assistance device is essentially a support frame with wheels and a seat for the user that is attached to a flexible strap. The user straddles the seat, which in turn is attached to a tensioning device, allowing the seat to be raised so as to transfer some or all of the user's weight from the user's legs to the walking rehabilitation assistance device. In some examples, the walking rehabilitation assistance device includes a rigid seat receiver that is connected to the flexible strap, to enable the use of different styles of seats such as bicycle seats, and may provide enhanced stability in certain circumstances.

DETAILED DESCRIPTION

Figure 1:
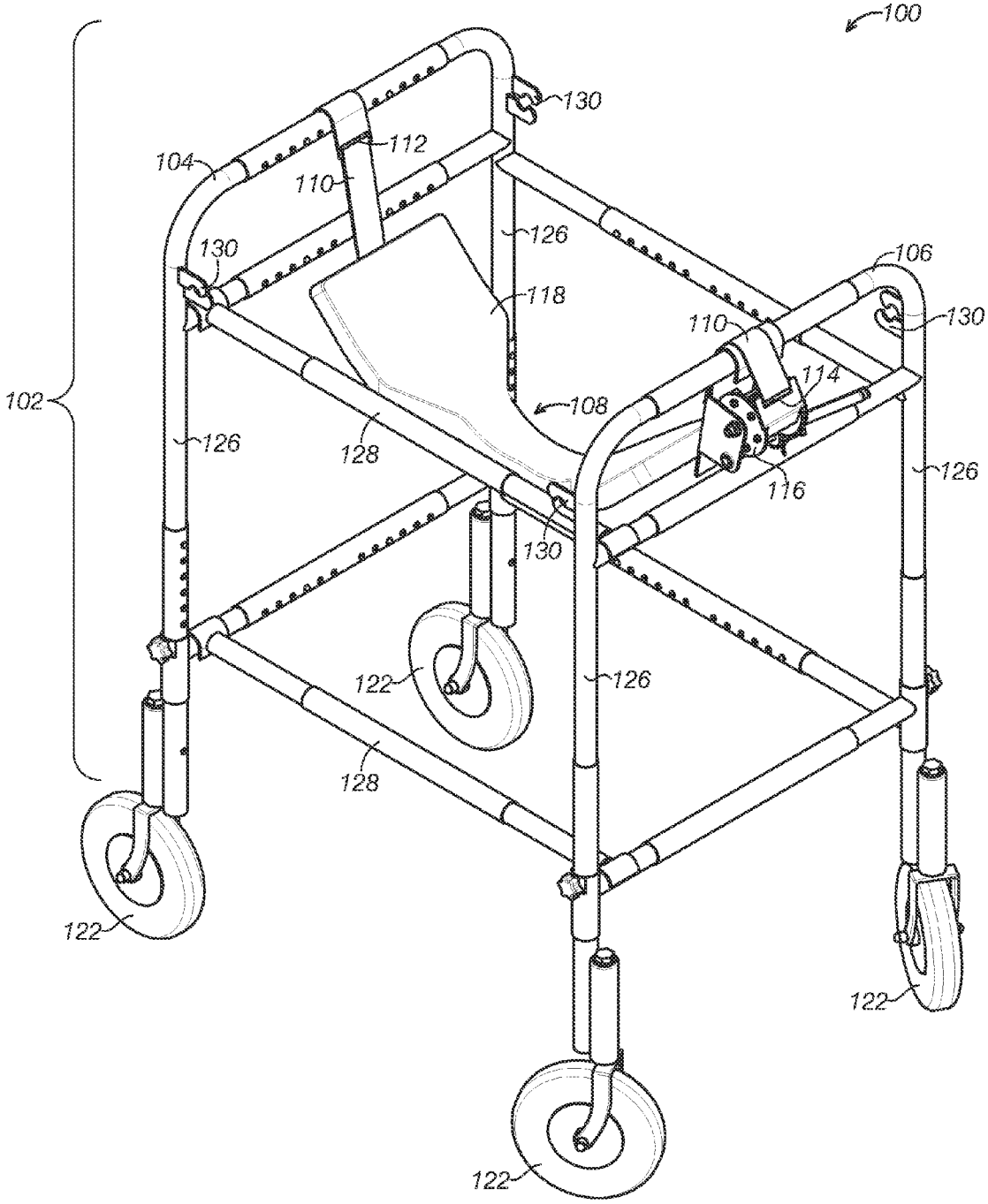
FIG. 1 is a perspective view of a first example of a walking rehabilitation assistance device.

The disclosed walking rehabilitation assistance devices will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various walking rehabilitation assistance devices are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

The disclosed walking rehabilitation assistance device (also variously called herein as a "walking rehabilitation device" or a "walking assistance device") functions to support a user patient, lightening the load on their legs and feet, while enabling them to go about day to day routines. Additionally or alternatively, the walking rehabilitation assistance device can be used to further a patient's assigned rehabilitation program in the comfort of their own home, potentially reducing the number of visits to a medical office or rehabilitation clinic. Further still, the disclosed walking rehabilitation assistance device can be converted to function much as a conventional walker. Owing to its four wheels, it facilitates a more natural and balanced gait as opposed to the aforementioned step-gather gait, where the same leg leads forward with each forward movement of the walker, and thereby helps to correct a dominant or stronger leg preference.

The disclosed walking rehabilitation assistance device addresses many of the shortcomings existing with conventional rehabilitation devices. For example, unlike the fixed treadmill apparatus and due to its light weight, relatively small size, and typical inclusion of wheels, the walking rehabilitation assistance device enables a user patient to be ambulatory in a fashion similar to a wheelchair or walker. Unlike a wheelchair or walker, however, the disclosed walking rehabilitation assistance device provides adjustable support and eases the load on a patient's legs and feet comparable to the fixed apparatus that is mounted over and used in conjunction with a treadmill. Thus, while the patient goes about daily activities, the patient is allowed to continuously work on their rehabilitation program without developing the bad habits that can be induced by continual usage of a conventional walker or wheelchair. Moreover, as will be disclosed below, the walking rehabilitation assistance device can be adapted to be used with an in-home treadmill, to approximate the equipment setup found in a rehabilitation clinic.

Figure 2:
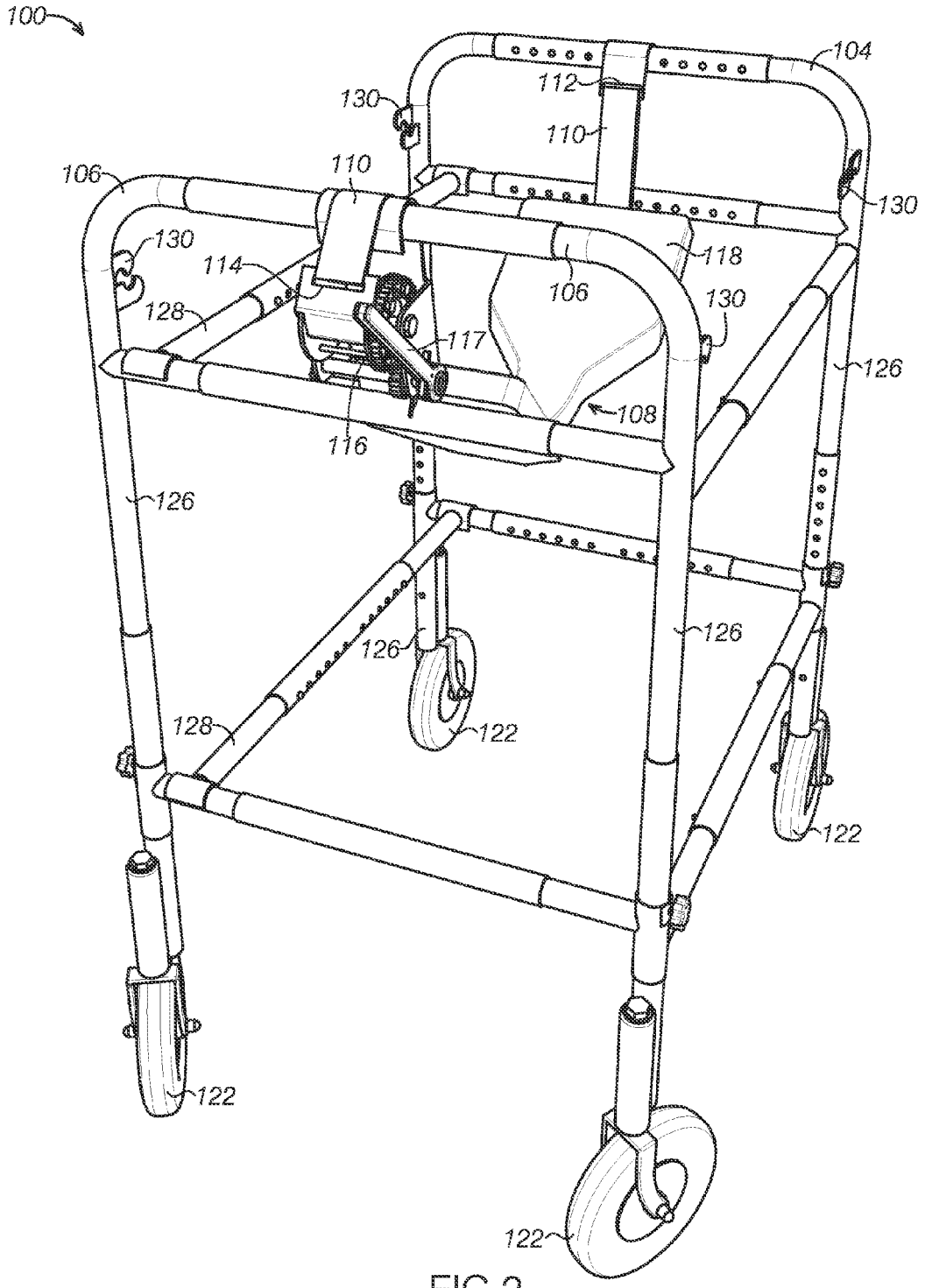
FIG. 2 is a close-up perspective view of the walking rehabilitation assistance device shown in FIG. 1 depicting the tensioning device.
Figure 3:
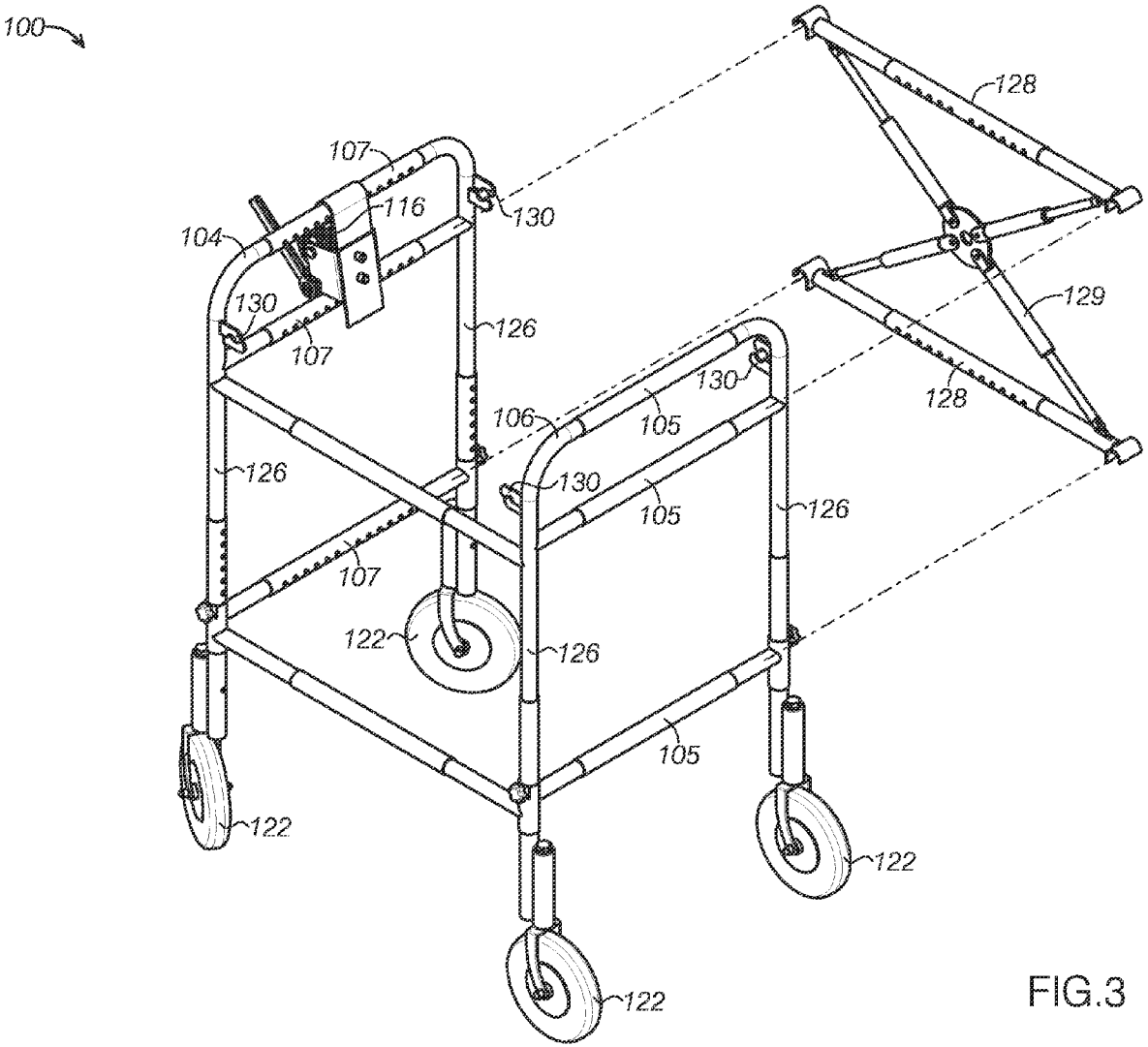
FIG. 3 is another perspective view of the walking rehabilitation assistance device shown in FIG. 1 showing the device configured to be used as a walker, with the removable cross members depicted.

With reference to FIGS. 1-3, a first example of a walking rehabilitation assistance device, walking assistance device 100, will now be described. The walking assistance device 100 includes a frame 102, which in turn is comprised of a first frame half 104 and a second frame half 106, which is adjustably connected to first frame half 104, both halves being adjustable in width. Between the first frame half 104 and the second frame half 106 is saddle 108, which is comprised of a strap 110 with a first end 112 and a second end 114. First end 112 of strap 110 is attached to first frame half 104, while second end 114 is attached to a tensioning device 116, which is in turn attached to second frame half 106, thereby allowing the overall length and tension upon strap 110 to be adjusted. A seat 118 is disposed on strap 110 so as to position a person 120 (depicted in FIG. 6) astride saddle 108 substantially equidistant between first frame half 104 and second frame half 106. The height of frame 102 can be adjusted so as to position saddle 108 to allow at least some of the weight of person 120 astride saddle 108 to be supported by saddle 108. Alternatively, the height of frame 102 could be adjusted to allow the walking assistance device 100 to be used as a seat. The amount of the person's 120 weight supported is controlled by adjusting tensioning device 116. As more tension is applied, strap 110 shortens and lifts seat 118 up, thereby receiving an increasing amount of the person's 120 weight, up to supporting the entirety of the user's weight.

As described above, frame 102 is assembled from first frame half 104 and second frame half 106, which are adjustably connected together. First frame half 104 and second frame half 106 can be connected together by one or more cross members 128, which may be separate components from first frame half 104 and second frame half 106 (as depicted), or as integral assemblies, thereby creating frame 102 as a unified structure. First frame half 104, second frame half 106, and cross members 128 are all preferably designed to be adjustable in length, and first frame half 104 and second frame half 106 are preferably adjustable for height, thereby allowing the dimensions of frame 102 to be adjusted in all directions to accommodate a wide variety of different sized users. First frame half 104 and second frame half 106, as shown in the figures, are preferably shaped as an inverted U, with each leg of the U forming a vertical post 126, which is made adjustable for height. On the bottom of vertical posts 126 are attached a plurality of wheels 122, with one wheel 122 for each vertical post 126. First frame half 104, second frame half 106, and cross members 128 are preferably constructed using hollow tubes; however, other types of structural members may be used, such as members with a square or rectangular cross-section, solid cross section members, e.g. bars or rods, or any other type of structural member suitable for constructing a frame capable of supporting some or all of the weight of the user. The structural members may be made from aluminum, steel, titanium, carbon fiber, wood, plastic, or any other material suitable for constructing a frame capable of supporting some or all of the weight of the user now known or later devised. The selection of material for the structural members will also depend on the type of structural member selected (e.g. tube, bar, round or square cross section, etc.).

Portions of first frame half 104, second frame half 106, and cross members 128 (collectively, the frame members), as depicted in the figures, are preferably made adjustable by utilizing a tubular construction and varying the diameter of sections of the various frame members so as to allow the adjustable portions of each frame member to telescope. Adjustable frame member sections are preferably constructed from two tubes, one having a smaller diameter than the other and fitting within the larger diameter tube. A series of holes are drilled along the length of the larger diameter tube, and a spring loaded retaining pin is inserted and affixed into the end of the smaller diameter tube, allowing the retaining pin to engage one of the holes in the larger diameter tube as it telescopes within the larger diameter tube. By depressing the retaining pin so that it disengages its current hole, then sliding the smaller diameter tube until a different hole is engaged by the retaining pin, the overall length of the frame member is adjusted. Other methods of rendering frame members adjustable that are now known or later devised in the relevant art can be employed as appropriate, such as retaining the telescoping section using a threaded adjustment knob installed in the larger diameter tube that inserts into a series of holes drilled along the length of the smaller diameter tube or engages the smaller diameter tube with a pressure friction pad, which would allow the length to be continuously adjustable, as opposed to predefined stops presented by a series of holes. Other methods could include a twisting pressure collar, interchangeable fixed length members, or a bar sliding within a channel.

In FIG. 2, tensioning device 116 is attached to saddle 108 by means of a strap 110, which runs from the first frame half 104 where its first end 112 is detachably affixed, through seat 118, to tensioning device 116, where its second end 114 is taken up into tensioning device 116 to adjust the length of strap 110. The tensioning device 116 in turn is affixed to second frame half 106. Strap 110 is shortened as it is taken up into tensioning device 116 as a tensioning lever 117 is operated, which is attached so as to intermittently manipulate tensioning device 116 in the direction needed to take up and shorten strap 110. This allows strap 110 to be progressively shortened, thereby allowing the desired amount of the user's weight to be absorbed by the seat 118 to be gradually increased, from no support to full support of the user's weight. First end 112 of strap 110 can be removably affixed to first frame half 104 by using a channel that snaps into place on the top tubular member of first frame half 104. Alternatively, any suitable method now known or later devised in the art can be used to make first end 112 removable, such as a latch, clasp, or hardware such as bolts and nuts, or any other mechanism that is capable of allowing first end 112 to be removed and support the weight of the user and tension applied to strap 110. Strap 110 is preferably constructed from a webbing material, such as is commonly used with seatbelts or for securely strapping objects. Such webbing material may be made from nylon, polyester, natural fiber, metal, plastic, or any other material that is flexible, capable of being tensioned, and can support the weight of the user while under tension. While strap 110 is depicted as a single strip of webbing, strap 110 could be implemented using a plurality of cords or straps. Seat 118 is attached to strap 110 preferably by passing it through seat 118, so that seat 118 freely slides upon strap 110, allowing it to be maintained in a position that is roughly equal in distance between first frame half 104 and second frame half 106, and also allowing seat 118 to be swapped for different styles and sizes to accommodate various users. Alternative implementations could have seat 118 as an integrated component with strap 110, and potentially made adjustable for length or width so that the position of the user is maintained correctly within frame 102. Seat 118 can be constructed from any suitable seating materials now known or later devised, such as foam, memory foam, plastic, wood, composite, natural batting, polyester, vinyl, metal, or rubber.

As depicted in FIG. 2, tensioning device 116 is implemented as a winch mechanism, as is well known in the art. In addition to tensioning lever 117, tensioning device 116 includes a reel which is attached to a ratcheting wheel. The ratcheting wheel includes a gear with a toothed surface on its side which is actuated by a second gear attached to the end of tensioning lever 117 by way of a one-way clutch. As tensioning lever 117 is actuated, the reel is turned by the attached ratcheting wheel, which in turn repeatedly engages a pawl to prevent the reel from turning in a direction that would unspool strap 110. The pawl can be disengaged when strap 110 needs to be lengthened, such as if saddle 108 needs to be disconnected to facilitate entry or exit from the walking assistance device 100. It will be appreciated icy someone skilled in the relevant art that the tensioning mechanism described in the foregoing is only one example of such a mechanism. Any mechanism capable of tensioning strap 110 sufficiently to hold up to the full weight of the user of walking assistance device 100 is suitable to use. Examples of appropriate tensioning mechanisms may include electric or hydraulically actuated winches, friction buckles where second end 114 of strap 110 is pulled through by hand, or any other mechanism capable of adjustably shortening and applying tension to strap 110, yet is sufficient to support the received weight of the user, that is now known or later devised.

FIG. 3 depicts walking assistance device 100 with saddle 108 removed, so as to configure walking assistance device 100 to be used in a conventional walker fashion. A user would enter walking assistance device 100 and place a hand each on first frame half 104 and second frame half 106 for support. Cross members 128 on at least one side of frame 102 are made removable, to enable a user to enter the walking assistance device 100. As shown, cross members 128 are removably attached to first frame half 104 and second frame half 106 by using a channel that snaps in place upon the frame half tube. Cross members 128 can alternatively be removably attached by any method now known or later devised in the relevant art, such as a clamp, latch, bolt or other such mechanism. The selected method for making cross members 128 removable may depend upon the materials and methods used to construct frame 102. Non-removable cross members 128 can be attached to first frame half 104 and second frame half 106 by use of such methods as welding, gluing, or hardware attachment such as bolts and nuts.

As shown in FIG. 3, the removable cross members 128 can be attached to a cross brace 129 to create a single gate mechanism that can be removed and collapsed, easing the process of entering the walking assistance device 100. By using cross members 128 and cross brace 129 in a gate configuration, a single assembly can be removed from the frame 102, rather than a plurality of cross members 128. This has the benefit of allowing entry into the walking assistance device and securing of the frame with a single hand. Cross brace 129, as seen in FIG. 3, is preferably a series of telescoping tubes arranged in an X-configuration, and articulated at the center junction. The use of a plurality of cross members 128 further enhances the rigidity of frame 102. In still other configurations, all cross members 128 used to create frame 102 can be made removable, allowing enter to walking assistance device 100 from either side, and further allowing walking assistance device 100 to be broken down into multiple low profile components so as to take up a minimal amount of space for storage or transport. Also seen in FIG. 3 are telescoping frame half sections 105 and 107, which allow first frame half 104 and second frame half 106 to be adjusted in length, as described above, and accessory mounting points 130, which can be used to attach additional exercise devices such as tension bands, or carrying accessories for hold drinks, snacks, bags, etc.

Figure 4A:
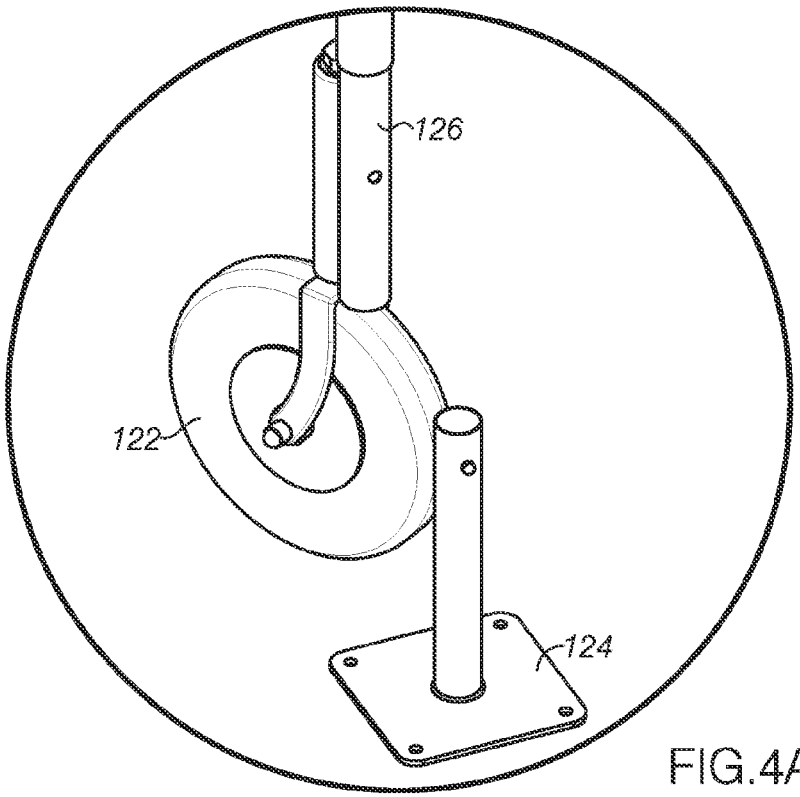
FIGS. 4A and 4B are perspective views of different feet and wheels that can be attached to the walking rehabilitation assistance device shown in FIG. 1.
Figure 4B:
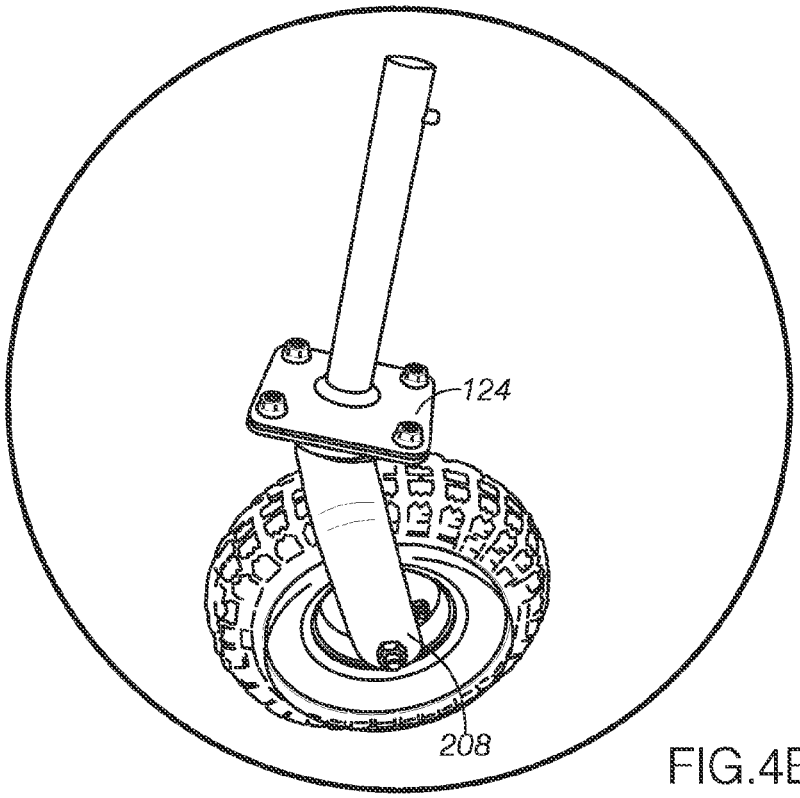

Turning to FIGS. 4A and 4B, wheels 122 and how they attach to vertical posts 126 are shown. Each wheel 122 is ideally removably mounted on a post via a caster to allow it to pivot 360 degrees. The post is inserted into a vertical post 126, and preferably secured. Wheel 122 can be removably secured into a vertical post 126 by use of a retaining pin that passes through the tube of vertical post 126 and through the post of wheel 122, an adjustment knob that is attached to vertical post 126 and either screws into the post of wheel 122 or applies pressure so as to retain wheel 122 by friction, a spring-loaded retaining pin inserted into the end of the post of wheel 122 that locks into corresponding holes in vertical post 126, or any other method now known or later devised in the relevant art. Additionally, each wheel 122 can optionally attach to vertical post 126 by use of a spring-loaded cartridge that can serve as a shock absorber. In yet other implementations where a removable wheel 122 is not necessary, wheel 122 can be attached to vertical post 126 by directly securing the caster to the bottom of vertical post 126. Wheel 122 can be manufactured from rubber, plastic, wood, metal, a non-marring material, or any other material now known or later devised suitable for creating a wheel that can withstand the rigors of daily walking use.

FIG. 4A also depicts a foot 124, which can be removably installed into vertical post 126 instead of wheel 122. Foot 124 can optionally be equipped with a non-marring bottom surface. A plurality of feet 124 can be installed when walking assistance device 100 is to be used on a stationary surface, such as in connection with a treadmill. Feet 124 are attached using the same mechanism as wheels 122. As with the plurality of wheels 122, feet 124 can be attached by way of a spring loaded cartridge. FIG. 4B depicts an optional pneumatic tire 208, which provides better control when using walking assistance device 100 over rougher terrain, such as outdoors, and provides a greater measure of shock absorbance. FIG. 4B shows an optional method to mount pneumatic tire 208, by removably attaching it to the bottom of foot 124. Alternatively, pneumatic tire 208 can be removably attached directly to vertical post 126 using a post similar to wheels 122 or feet 124. Still further, wheels 122 can be designed to bolt to feet 124, similar to how pneumatic tire 208 is shown. Where wheels 122 and pneumatic tires 208 are removably attached to feet 124, feet 124 can optionally be integrated into the bottom of vertical posts 126, such as by welding, gluing, or forming. It should be appreciated that a variety of other attachments can be affixed onto feet 124 to accommodate any type of terrain that practically can be navigated with the walking assistance device 100.

Figure 5:
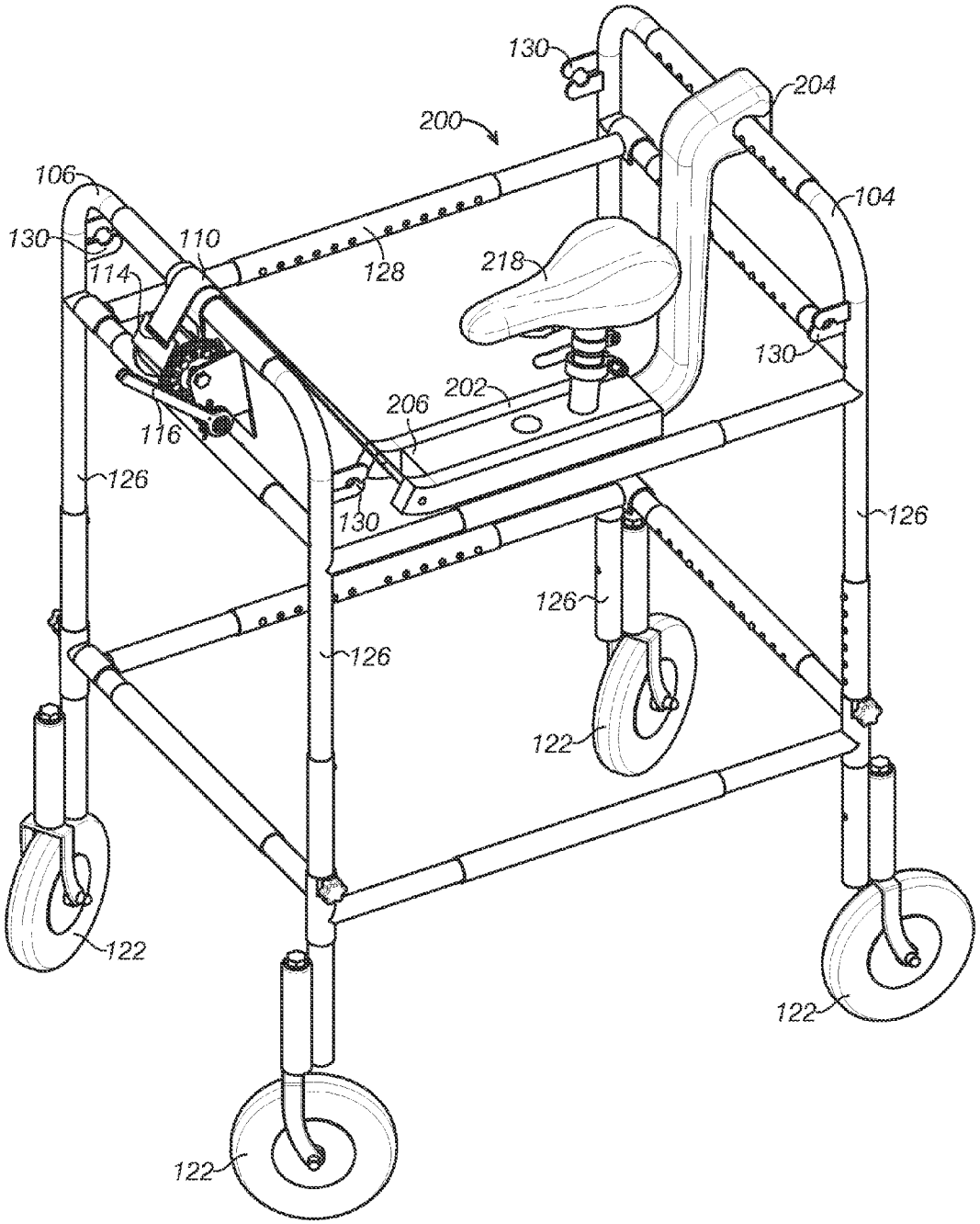
FIG. 5 is a perspective view of a second example of a walking rehabilitation assistance device including a different co figuration of saddle seat that is removable.

Turning attention to FIG. 5, a second example of a walking rehabilitation device 200 will now be described. Walking rehabilitation device 200 includes many similar or identical features to walking assistance device 100. Thus, for the sake of brevity, each feature of walking rehabilitation device 200 will not be redundantly explained. Rather, key distinctions between walking rehabilitation device 200 and walking assistance device 100 will be described in detail and the reader should reference the discussion above for features substantially similar between the two walking rehabilitation assistance devices.

As can be seen in FIG. 5, walking rehabilitation device 200 includes a frame 102, consisting of a first frame half 104 that is width adjustable and a second frame half 106 that is width adjustable, each of first frame half 104 and second frame half 106 shaped substantially as an upside-down U so as to provide two vertical posts 126 that are each height-adjustable, with first frame half 104 and second frame half 106 tied together using a plurality of length-adjustable cross members 128. Walking rehabilitation device 200 also includes a tensioning device 116 attached to first frame half 104, and a saddle 108, consisting of a strap 110 with a first end 112 and a second end 114, first end 112 being attached to tensioning device 116; a seat receiver 202 with a first receiver end 204 and a second receiver end 206, with first receiver end 204 being attached to second frame half 106, and second receiver end 206 being attached to second end 114 of strap 110; and a seat 118 that is removably disposed upon seat receiver 202 so as to be positioned substantially equidistant from first frame half 104 and second frame half 106.

The primary difference between walking assistance device 100 and walking rehabilitation device 200 as seen in FIG. 5 is the differing implementation of saddle 108. Where walking assistance device 100 uses a saddle 108 where strap 110 passes through a seat 118, saddle 108 as implemented in walking rehabilitation device 200 includes a seat receiver 202 designed to easily accept a variety of different types of seats 118, such as bicycle saddles, that might not easily mount directly upon strap 110, which is flexible. Seat receiver 202 is preferably rigid, which can lend additional stability for some users, and includes a first receiver end 204 that is attached to first frame half 104, with a second receiver end 206 that is attached to second end 114 of strap 110, and first end 112 of strap 110 being attached to tensioning device 116. As with first end 112 of strap 110 discussed above, first receiver end 204 is preferably removably attached to first frame half 104, and is preferably attached in a pivoting fashion to accommodate the changing tensions on strap 110. In the depicted embodiment of FIG. 5, seat receiver 202 is shown with a plurality of holes through which to secure seat 118, which is mounted upon a pole that inserts into one of the plurality of holes. This enables easily swapping seat 118 for a variety of different styles to suit individual users. Alternatively, seat 118 could attach to seat receiver 202 using a sliding rail, or by any other means now known or later devised that allow seat 118 to be easily changed, and adjusted for location so as to place seat as close to equidistant between first frame half 104 and second frame half 106. Seat receiver 202 is preferably rigid, and can be constructed out of aluminum, titanium, carbon fiber, other metal, wood, plastic, or any other suitable material now known or later devised that can support both the weight of the user and tensions placed via strap 110.

Figure 6:
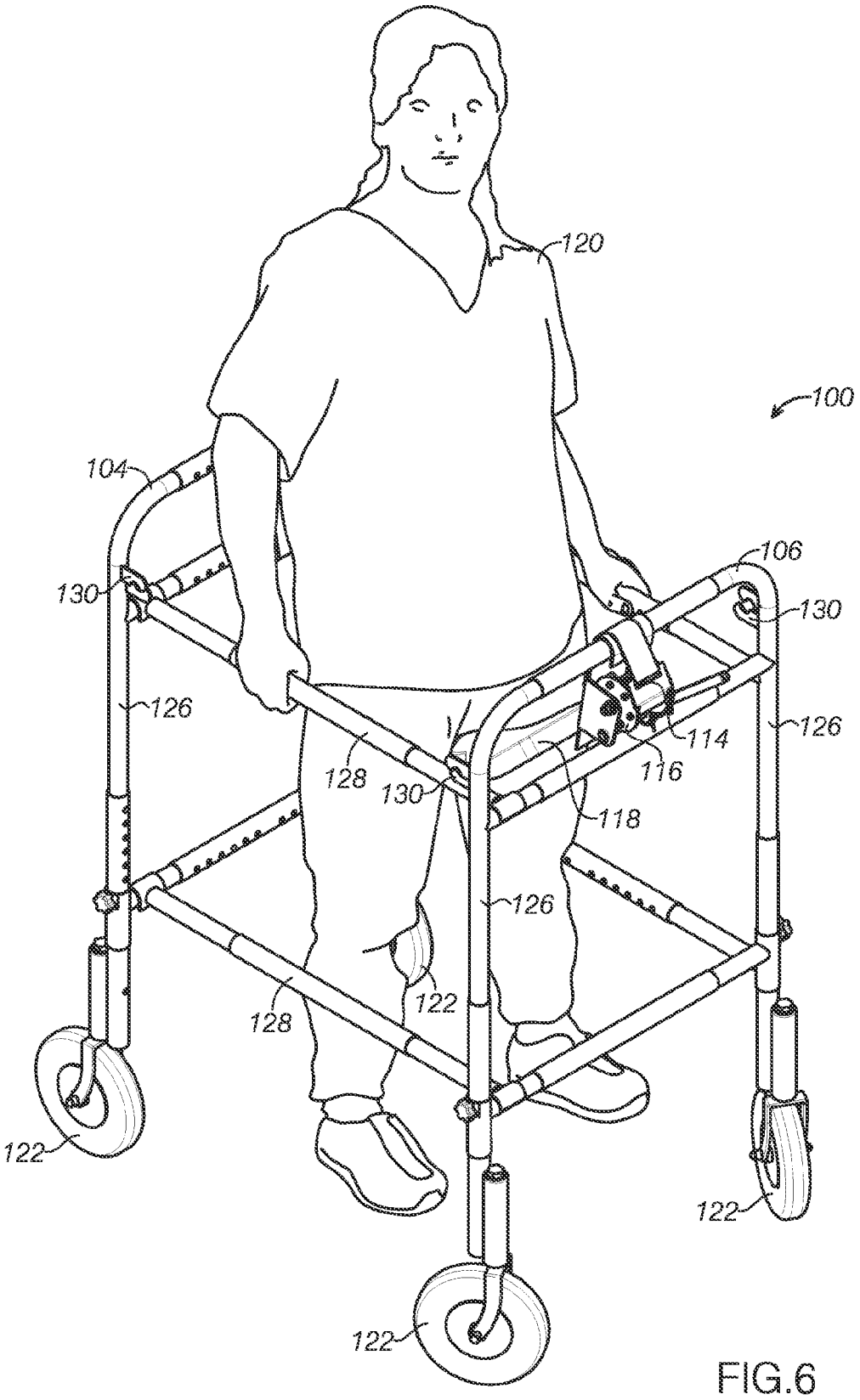
FIG. 6 is a perspective view of the walking rehabilitation assistance device in use.

Turning attention to FIG. 6, which depicts walking assistance device 100 in use, a method 300 of using the walking rehabilitation assistance device will now be described. Method 300 includes first providing a walking assistance device 100 or walking rehabilitation device 200, as described above, positioning the patient astride saddle 108, and adjusting the height of frame 102 so that seat 118 is just contacting the patient when the patient is standing; and adjusting tensioning device 116 so that at least some of the patient's weight is removed from the patient's legs and supported by walking rehabilitation device 200. User is a person 120 who typically stands astride saddle 108 facing tensioning device 116, so as to allow person 120 to adjust tension to an optimal level for rehabilitation. Person 120 can use walking assistance device 100 or walking rehabilitation device 200 for day to day activities, or in connection with a specific rehabilitation routine that is commercially available or developed by a health professional, or both.

Person 120 can enter walking assistance device 100 by removing one or snore of the cross members 128, and disconnecting the strap 110 or seat receiver 202 (as appropriate) from the first frame half 104. This allows seat 118 to drop down, thereby allowing person 120 to step easily into the walking assistance device 100. Prior to use, frame 102 should be adjusted in width and length to be optimal for the build of person 120, and so that the height of the seat 118 when untensioned ideally just comes up to the bottom of the person's 120 crotch. Cross members 128 are replaced between first frame half 104 and second frame half 106, thereby enclosing the person 120. Strap 110 is reconnected to first frame half 104, allowing person 120 to sit. Straps or pull cords may be attached to strap 110 as needed to allow person 120 to retrieve and reconnect strap 110 to first frame half 104 without needing to bend over, for users with limited upper body mobility. Tensioning device 116 is adjusted as needed to add or remove person's 120 weight from off their legs and feet. Plurality of wheels 122 allow person 120 to move about by walking, but with a desired portion of the person's 120 weight being absorbed by the walking assistance device 100, so as to allow the user to focus on correct posture and gait. Walking rehabilitation device 200 is utilized in the same fashion as described above for walking assistance device 100.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims whether they are directed to the same invention or a different invention and whether they are different, broader, narrower or equal in scope to the original claims, are to be considered within the subject matter of the inventions described herein.

The invention claimed is:

1. A walking assistance device, comprising:

a frame, comprising:

a first frame half that is adjustable in width; and a second frame half that is adjustable in width and adjustably connected to the first frame half; and a saddle, comprising:

a strap possessing a first end and a second end,the first end being attached to the first frame half;

a tensioning device attached to the second frame half, with the second end of the strap being attached to the tensioning device so as to allow the overall length and tension upon the strap to be adjusted; and a seat disposed on the strap so as to position a person astride the saddle substantially equidistant between the first frame half and the second frame half;

wherein the height of the frame can be adjusted so as to position the saddle to allow at least some of the weight of the person astride the saddle to be supported by the saddle, the amount of weight supported being altered by adjusting the tensioning device.

2. The walking assistance device of claim 1, further comprising a plurality of wheels attached to the frame.

3. The walking assistance device of claim 1, further comprising a plurality of feet suitable for stationary use on a flat surface, each of the plurality of feet being attached to the frame.

4. The walking assistance device of claim 1, wherein the frame is constructed of aluminum.

5. The walking assistance device of claim 1, wherein the frame is constructed of carbon fiber.

6. The walking assistance device of claim 1, wherein the first frame half and the second frame half are each substantially shaped in the form of an upside-down U, so that each of the first frame half and the second frame half possesses two vertical posts.

7. The walking assistance device of claim 6, wherein the first frame half is adjustably connected to the second frame half at least partially by a plurality of removable cross members.

8. The walking assistance device of claim 7, wherein the frame is substantially square in shape, with a wheel attached to each vertical post of the first frame half and the second frame half to facilitate movement of the device.

9. The walking assistance device of claim 1, wherein the strap is comprised of webbing.

10. A walking rehabilitation device, comprising:

a frame, consisting of a first frame half that is width adjustable and a second frame half that is width adjustable, each of the first frame half and the second frame half shaped substantially as an upside-down U so as to provide two vertical posts that are each height-adjustable, with the first frame half and the second frame half tied together using a plurality of length-adjustable cross members;

a tensioning device attached to the first frame half; and a saddle, consisting of:

a strap with a first end and a second end, the first end being attached to the tensioning device;

a seat receiver with a first receiver end and a second receiver end, with the first receiver end being attached to the second frame half, and the second receiver end being attached to the second end of the strap; and a seat that is removably disposed upon the seat receiver so as to be positioned substantially equidistant from the first frame half and the second frame half.

11. The walking rehabilitation device of claim 10, wherein the frame is comprised of aluminum.

12. The walking rehabilitation device of claim 10, wherein the frame is comprised of carbon fiber.

13. The walking rehabilitation device of claim 10, further comprising a plurality of wheels, each of the plurality of wheels corresponding with and being removably attached to one of the vertical posts.

14. The walking rehabilitation device of claim 10, further comprising a plurality of feet, each of the plurality of feet corresponding with and being removably attached to one of the vertical posts.

15. The walking rehabilitation device of claim 10, further comprising a plurality of pneumatic tires suitable for traversing rough terrain, each of the plurality of pneumatic tires corresponding with and being removably attached to one of the vertical posts.

16. The walking rehabilitation device of claim 10, wherein the frame can be raised so as to allow the seat to contact a user of the walking rehabilitation device standing astride the saddle.

17. A method for rehabilitating a patients walking, comprising:

providing a walking rehabilitation device comprised of:

a frame comprised of a first frame half and a second frame half, the first frame half and the second frame half being adjustable for height and width, and attached to each other with a plurality of length-adjustable cross-members;

a saddle comprising:

a tensioning device attached to the first frame half;

a strap with a first end and a and second end, with the first end attached to the tensioning device so as to allow the strap to be adjusted for length and tension; and a seat attached to the strap and positioned as to be substantially equidistant between the front and rear frames; and a plurality of wheels attached to the frame;

positioning the patient astride the saddle, and adjusting the height of the frame so that the seat is just contacting the patient when the patient is standing; and adjusting the tensioning device so that at least some of the patient's weight is removed from the patient's legs and supported by the walking rehabilitation device.

18. The method of claim 17, wherein the plurality of wheels attached to the frame are removably attached, and are replaced with a plurality of feet to enable the walking rehabilitation device to be used in connection with a treadmill.

19. The method of claim 17, further comprising using the device in connection with a predetermined rehabilitation routine.

20. The method of claim 17, further comprising one or more accessory mounting points where additional rehabilitation equipment may be attached.

* * * * *